US012630993B2

(12) United States Patent
Cui et al.

(10) Patent No.: US 12,630,993 B2
(45) Date of Patent: May 19, 2026

(54) SYSTEM FOR LOADING DYNAMIC STRESS ON SUBGRADE OR FOUNDATION BASED ON MULTI-SERVO CHANNEL AND CONTROL METHOD THEREOF

(71) Applicants: SHANDONG JIAOTONG UNIVERSITY, Jinan (CN); SHANDONG UNIVERSITY, Jinan (CN); CHONGQING UNIVERSITY, Chongqing (CN); JINAN DOCER TESTING MACHINE TECHNOLOGY CO., LTD., Jinan (CN)

(72) Inventors: Xinzhuang Cui, Jinan (CN); Jin Li, Jinan (CN); Zhenhao Bao, Jinan (CN); Jianwen Hao, Jinan (CN); Yefeng Du, Jinan (CN); Qing Jin, Jinan (CN); Xiaoning Zhang, Chongqing (CN); Xudong Wang, Jinan (CN); Jiong Zhang, Jinan (CN); Shengqi Zhang, Jinan (CN); Yilin Wang, Jinan (CN); Xiangyang Li, Jinan (CN); Shirong Yan, Chongqing (CN); Tiancai Cao, Jinan (CN)

(73) Assignees: SHANDONG JIAOTONG UNIVERSITY, Jinan (CN); SHANDONG UNIVERSITY, Jinan (CN); CHONGQING UNIVERSITY, Chongqing (CN); JINAN DOCER TESTING MACHINE TECHNOLOGY CO., LTD., Jinan (CN)

( * ) Notice: Subject to any disclaimer, the term of this patent is extended or adjusted under 35 U.S.C. 154(b) by 0 days.

(21) Appl. No.: 19/103,937

(22) PCT Filed: Oct. 18, 2023

(86) PCT No.: PCT/CN2023/125266
§ 371 (c)(1),
(2) Date: Feb. 14, 2025

(87) PCT Pub. No.: WO2024/083163
PCT Pub. Date: Apr. 25, 2024

(65) Prior Publication Data
US 2026/0009200 A1 Jan. 8, 2026

(30) Foreign Application Priority Data
Oct. 19, 2022 (CN) ..... 202211279529.2

(51) Int. Cl.
*E02D 33/00* (2006.01)
*E01C 3/00* (2006.01)

(52) U.S. Cl.
CPC ..... *E02D 33/00* (2013.01); *E01C 3/00* (2013.01)

(58) Field of Classification Search
CPC ..... E02D 33/00; E01C 3/00; Y02T 90/00; G01N 3/36; G06N 3/0499; G06N 3/08
See application file for complete search history.

(56) References Cited

U.S. PATENT DOCUMENTS 4,662,473 A * 5/1987 Betz ..... G01V 1/053 181/114
6,035,715 A * 3/2000 Porter ..... G01N 29/46
(Continued)

FOREIGN PATENT DOCUMENTS

CN 103558079 A 2/2014
CN 103760045 A 4/2014
(Continued)

*Primary Examiner* — Freddie Kirkland, III
(74) *Attorney, Agent, or Firm* — IPro, PLLC; Na Xu

(57) ABSTRACT

A system for loading dynamic stress on subgrade or foundation based on multi-servo channel and a control method thereof. The system comprises: connecting plate; five dynamic actuators are hinged between connecting frame and the connecting plate; four of them form 4-RPR parallel mechanism, another one is arranged in middle of the 4-RPR parallel mechanism; loading part is mounted at center under the connecting frame; and restraining plate is arranged under the loading part and freely contacts with the loading part;
(Continued)

four static actuators are arranged between the restraining plate and the connecting plate; wherein, the static actuators and dynamic actuators are dynamic-static cooperative controlled through multi-servo channel, to simulate principal stress axes rotation effect of a soil body of subgrade or foundation The system can realize the principal stress axes rotation effect in the subgrade or foundation through dynamic-static cooperative loading and can simulate different traffic load forms.

10 Claims, 3 Drawing Sheets

(56) References Cited

U.S. PATENT DOCUMENTS

| | | | | |
|---|---|---|---|---|
| 6,247,366 | B1 * | 6/2001 | Porter | G11B 33/14 |
| 7,624,648 | B2 * | 12/2009 | Nickel | G01N 3/32 73/856 |
| 10,495,556 | B2 * | 12/2019 | Rust | G01N 3/36 |
| 2012/0103106 | A1 * | 5/2012 | Feng | G01N 3/36 73/803 |

FOREIGN PATENT DOCUMENTS

| | | | |
|---|---|---|---|
| CN | 110700225 | A | 1/2020 |
| CN | 216284746 | U | 4/2022 |
| CN | 115479833 | A | 12/2022 |
| CN | 115480049 | A | 12/2022 |
| CN | 115748835 | A | 3/2023 |
| JP | 2005098018 | A | 4/2005 |
| JP | 2010066148 | A | 3/2010 |

* cited by examiner

SYSTEM FOR LOADING DYNAMIC STRESS ON SUBGRADE OR FOUNDATION BASED ON MULTI-SERVO CHANNEL AND CONTROL METHOD THEREOF

This application claims priority benefits to Chinese Patent Application No. 202211279529.2, entitled "MULTI-SERVO CHANNEL-BASED ROADBED FOUNDATION DYNAMIC STRESS LOADING SYSTEM AND CONTROL METHOD", filed on Oct. 19, 2022, with the China National Intellectual Property Administration (CNIPA), the entire contents of which are incorporated herein by reference.

TECHNICAL FIELD

The invention relates to the technical field of simulation systems, in particular to a system for loading dynamic stress on subgrade or foundation based on multi-servo channel and a control method thereof.

BACKGROUND

The dynamic response of subgrade and foundation structure under traffic load is different from that under static load, but the design method in practical engineering is still based on the response under static load assumption. For soil body of the subgrade or foundation, the movement characteristics of traffic load will cause the effect of principal stress axes rotation in the vertical section of the route. This special stress loading and unloading paths make the soil body bear stress characteristics different from single point cyclic loading, which will aggravate the deformation and failure of the soil body, cause the settlement deformation of subgrade or foundation, and then cause damage to highway pavement, airport pavement and railway track and other superstructure.

Therefore, it is very important to realize the true reproduction and accurate simulation of dynamic response of the subgrade or foundation under railway-highway-airport traffic loads by considering the principal stress axes rotation of soil body.

The existing loading simulation system for subgrade or foundation dynamic response mainly has the following problems:

(1) The effect of the principal stress axes rotation is difficult to realize. In the prior art, the simulation of the effect of the principal stress axes rotation is mainly realized through distributed time sequence loading of a plurality of vertical excitation forces. However, the above loading system is only applied to railway engineering, and can only be loaded on the rails. A completion of building the entire track-subgrade-foundation structure is required, which is time-consuming and laborious, and cannot be loaded directly on any structural layer of subgrade or foundation.

(2) Single application scenario. The existing dynamic loading equipment can only simulate train load, and lacks a traffic loading simulation system that can be simultaneously applied to railway-highway-airport scenario.

(3) Multi-cylinder dynamic and static cooperative loading system with high control precision and fast response can simulate the dynamic response of subgrade or foundation, but its parameters are variable and difficult to determine, which makes it difficult to establish accurate model. Although the existing control methods have solved the problem of proportional integral derivative (PID) parameter estimation and adaptive adjustment, they are still a PID controller in essence, and there are still limitations for the control of nonlinear complex systems with multi-cylinder dynamic and static cooperative loading.

SUMMARY

For overcoming the above-mentioned problems existing in the prior art, it is an object of the present invention to provide a system for loading dynamic stress on subgrade or foundation based on multi-servo channel and a control method thereof. In order to achieve the above objects, the present invention adopts the following technical solution:

In a first aspect, the present invention provides a system for loading dynamic stress on subgrade or foundation based on multi-servo channel, comprising:

a connecting plate:

a connecting frame, wherein five dynamic actuators are hinged between the connecting frame and the connecting plate: wherein, four of the five dynamic actuators form a 4-revolute-pose-revolute (RPR) parallel mechanism, and another one is arranged in a middle of the 4-RPR parallel mechanism:

a loading part, being mounted at a center under the connecting frame: and a restraining plate, being provided under the loading part and configured to have free contact with the loading part: four static actuators are arranged between the restraining plate and the connecting plate: wherein, the four static actuators and the five dynamic actuators are dynamic-static cooperative controlled through multi-servo channel, to simulate an effect of principal stress axes rotation of a soil body of a subgrade or a foundation.

As a further technical solution, the connecting frame is of a cross shape, and each of the four static actuator passes through interspaces between adjacent cross support rods of the connecting frame, respectively.

As a further technical solution, hinge points of the 4-RPR parallel mechanism are arranged on the cross support rods of the connecting frame.

As a further technical solution, one end of the each of the four static actuators is fixedly connected to the connecting plate, and another end of the each of the four static actuators is ball hinged with the restraining plate.

As a further technical solution, the four static actuators are perpendicular to the connection plate and the restraining plate.

As a further technical solution, a displacement sensor and an axial force sensor are installed inside the each of the four static actuators and each of the five dynamic actuators, respectively.

As a further technical solution, the present invention further comprises a multi-servo channel control system for independently adjusting loading force of the each of the four static actuators and the each of the five dynamic actuators.

As a further technical solution, the present invention further comprises a monitoring element embedded inside a subgrade structure or a foundation structure.

As a further technical solution, the dynamic actuator arranged in the middle of the 4-RPR parallel mechanism is vertically arranged between the connecting plate and the connecting frame.

In a second aspect, the present invention provides a control method of the system for loading dynamic stress on subgrade or foundation based on multi-servo channel according to the first aspect, comprising the following steps:

building an experience pool and a feedforward neural network, initializing parameters of the network:

building training samples to train the feedforward neural network, and obtaining an initial loading spectrum and a loading frequency of an actuator:

training and updating continuously the parameters of the network based on a loss function and stochastic gradient descent algorithm, until an iterative condition is judged to be satisfied, and finally outputting a time-history loading curve of each servo channel in a stable state; and controlling, by a multi-servo channel control system, a dynamic and static cooperative cyclic loading of static and dynamic actuators, to simulate dynamic response of subgrade or foundation under long-term load: simultaneously, applying different static loads to a restraining plate, to simulate varying degrees of ballast and restraint of an overlying structure on the subgrade or foundation.

The beneficial effects of the present invention are as follows:

(1) According to the present invention, the system for loading dynamic stress on subgrade or foundation based on multi-servo channel, can realize the effect of the principal stress axes rotation in the subgrade or foundation through dynamic and static cooperative loading, and can simulate different traffic load forms, such as cars, high-speed trains, heavy-haul trains, subway trains and aircraft and other vehicles: the application scenarios are broad.

(2) According to the present invention, the loading system thereof has novel structure and layout, and can accurately simulate the dynamic stress characteristics of any structural layer inside the subgrade and foundation. Meanwhile, the loading system can be applied to field in-situ test and full-scale model test, and the subgrade and foundation structure can be tested without building a complete traffic infrastructure structure, saving time and labor and saving cost.

(3) According to the present invention, optimizing PID algorithm by using deep reinforcement learning (DRL) method has been proposed, to avoid data inaccuracy caused by parameter correlation, so as to control output result in stable region of parameters, and to adapt to nonlinear, time-varying and disturbing multi-servo channel loading system, so as to output loading time history curve in stable state, and finally realize true and accurate simulation of dynamic stress on subgrade or foundation.

BRIEF DESCRIPTION OF THE DRAWINGS

The accompanying drawings, which constitute a part of the present invention, are used to provide further understanding of the present invention. The illustrative embodiments and their descriptions of the present invention are used to explain the present invention and do not constitute limitations on the present invention. It should also be understood that these figures are shown for simplicity and clarity, and may not necessarily be drawn to scale. The present invention will now be described and explained using the accompanying drawings with additional features and details, wherein.

In the figures: 1, surface of subgrade or foundation: 2, loading parts: 3, dynamic actuator: 4, static actuator: 5, connecting plate: 6, connecting frame: 7, restraining plate: 8, wire: 9, monitoring element: 10, oil distributor: 11, multi-servo channel control system: 12, hydraulic system: 13, oil pipeline.

DETAILED DESCRIPTION

The following will provide a clear and complete description of the technical solutions in typical examples of the present invention, in conjunction with the accompanying drawings.

Example 1

Figure 1:
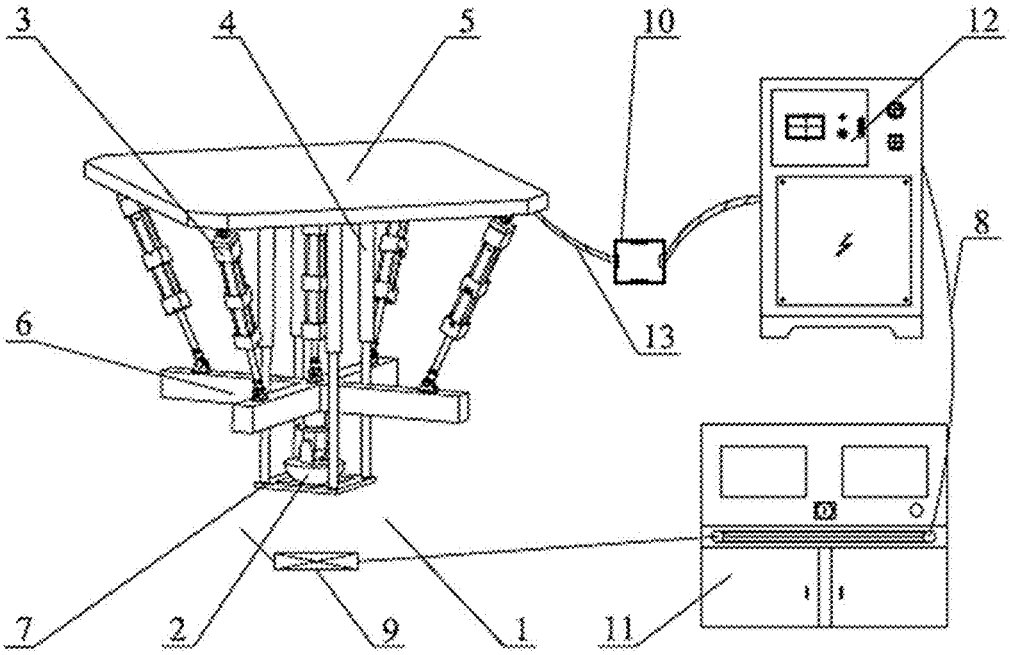
FIG. 1 is a schematic diagram of a system for loading dynamic stress on subgrade or foundation based on multi-servo channel in one example of the present invention.

As shown in FIG. 1, the present example provides a system for loading dynamic stress on subgrade or foundation based on multi-servo channel, comprising a restraining loading device, a power system and a control system, wherein the restraining loading device comprises a connecting plate 5, a connecting frame 6, a loading part 2 and a restraining plate 7.

In the present example, the connecting plate 5 is a square plate.

Five dynamic actuators 3 are hinged between the connecting frame 6 and the connecting plate 5, wherein four of which form a 4-RPR parallel mechanism, and another one is arranged in the middle of the 4-RPR parallel mechanism: wherein, using R to represent a rotating pair and using P to represent a moving pair, then one end of the dynamic actuator 3 is hinged with the connecting plate 5 and another end is hinged with the connecting frame 6. The four dynamic actuators forming the 4-RPR parallel mechanism form acute angles with the connecting plate 5 and obtuse angles with the connecting frame 6. The dynamic actuator 3 disposed in the middle of the 4-RPR parallel mechanism is vertically disposed between the connecting plate 5 and the connecting frame 6. The dynamic actuators 3 are hydraulic cylinders, and the static actuators 4 also are hydraulic cylinders.

The loading part 2 is mounted at the center under the connecting frame 6, and the connecting frame 6 is fastened and connected to the loading part 2 through bolts and transmits dynamic load to a surface of subgrade or foundation 1.

The restraining plate 7 is used for contacting the surface of subgrade or foundation 1, and is arranged below the loading part 2 and freely contacts with the loading part 2: four static actuators 4 are arranged between the restraining plate 7 and the connecting plate 5, one end of the static actuator 4 is fixedly connected to the connecting plate 5 through a high-strength bolt, and another end of the static actuator 4 is spherically hinged with the restraining plate 7. The static actuators 4 are perpendicular to the connecting plate 5 and the restraining plate 7. The static actuators 4 directly contact the surface of subgrade or foundation 1 to perform restraining loading, which is used for simulating the restraining action of the weight of the overlying structure on soil body of the subgrade or foundation. Varying degrees of ballast and restraining action of the overlying structure on the subgrade or foundation are simulated by applying different static loads. The static actuators 4 and the dynamic actuators 3 are dynamic-static cooperative controlled to simulate the effect of the principal stress axes rotation of the soil body of the subgrade or foundation.

In the present example, the connecting frame 6 is of a cross-shaped frame and has four cross support rods: adjacent cross support rods are vertical. Specifically, there is a interspace between the two adjacent cross support rods, and each the static actuator 4 respectively passes through the interspace between the adjacent cross support rods of the connecting frame 6. That is, one static actuator 4 passes through one interspace between the adjacent cross support rods, to avoid an interference of the coupling frame 6 with the static actuator 4.

The hinge points of the 4-RPR parallel mechanism are set on the cross support rods of the connecting frame 6, and the hinge point of the remaining one dynamic actuator is set at an intersection of the cross support rods, i.e., a center position of the connecting frame.

Each actuator is connected to a hydraulic system 12 and a multi-servo channel control system 11 through a specific pipeline. Displacement sensors and axial force sensors are installed inside the static actuators 4 and the dynamic actuators 3, for feeding back radial displacements and radial forces.

The multi-servo channel control system 11 is able to adjust the loading force of each static actuator 4 and each dynamic actuator 3 independently, and comprises a monitoring element 9 and a data processing unit. The monitoring element 9 is embedded in the field and connected to the multi-servo channel control system 11 in a wired or wireless way, and can acquire multiple information such as deformation, stress, pore pressure, temperature and moisture of soil body of the subgrade or foundation. The multi-servo channel control system 11 carries out comprehensive analysis and judgment according to multi-information such as dynamic stress characteristics of the subgrade or foundation, and completes intelligent regulation of working state of each the actuator under each servo channel.

Each the static actuator 4 and the dynamic actuator 3 is connected to the multi-servo channel control system 11 via a line 8, each the actuator corresponding to a channel of the multi-servo channel control system 11. The multi-channel servo control system 11 comprises a PC and a multi-channel loading control program.

The hydraulic system 12 distributes hydraulic oil to each of the static actuators 4 and each of the dynamic actuators 3 via an oil distributor 10. The oil distributor 10 is respectively connected to each of the static actuators 4 and each of the dynamic actuators 3 through an oil pipeline 13 to cooperatively control the action of each the actuator.

Example 2

Figure 2:
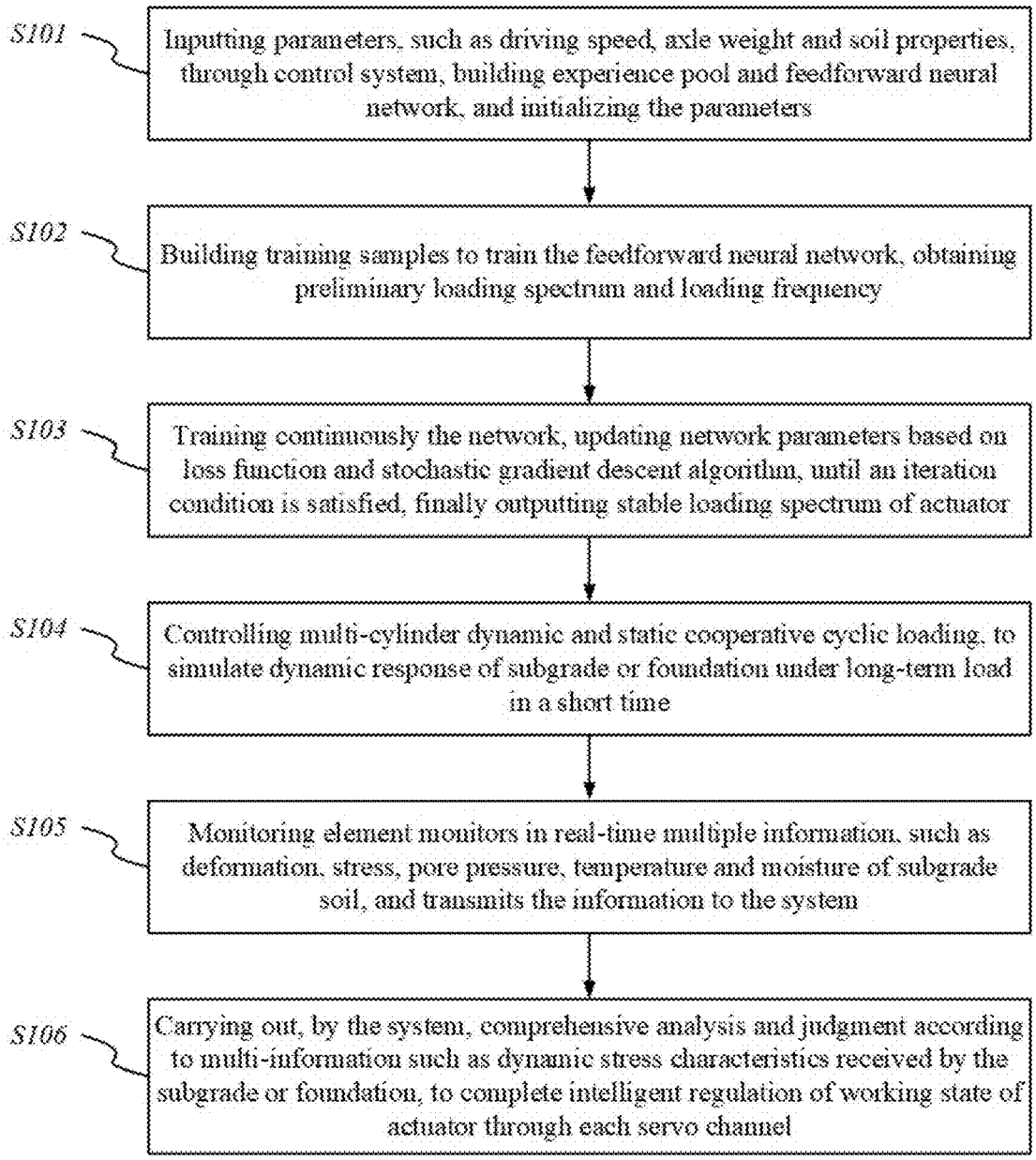
FIG. 2 is a conceptual diagram of an intelligent control method based on DRL in one example of the present invention.
Figure 3:
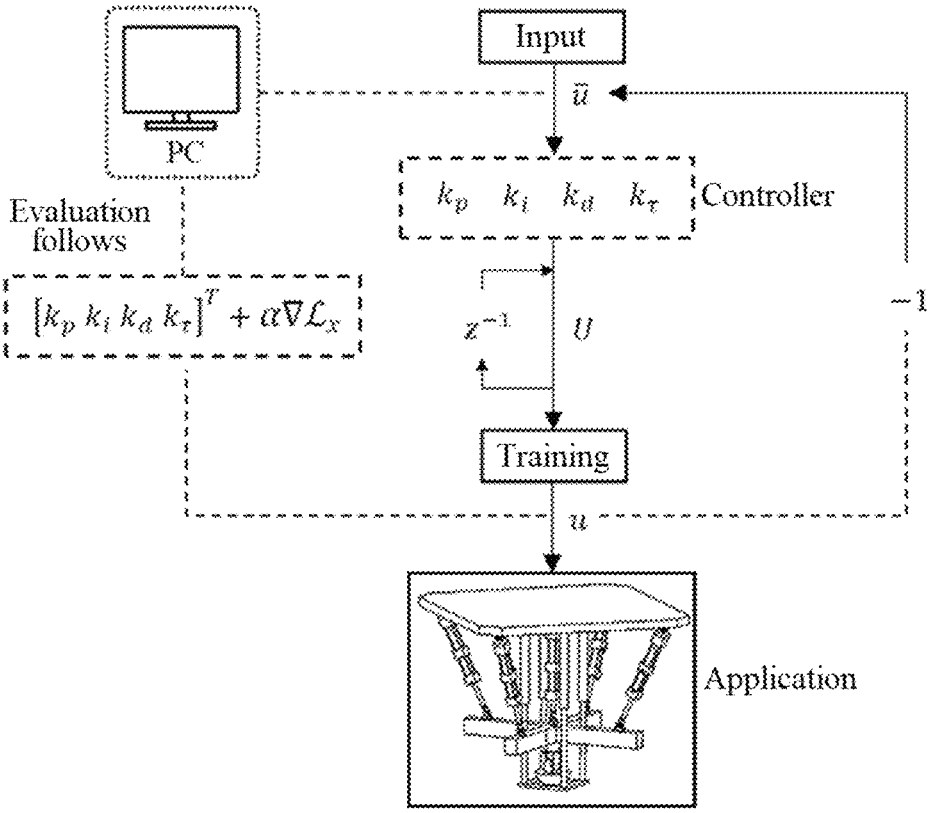
FIG. 3 is a flowchart of steps of the intelligent control method based on DRL in one example of the present invention.

As shown in FIGS. 2 and 3, the present example provides a control method for a system for loading dynamic stress on subgrade or foundation based on multi-servo channel according to the example 1, comprising the following steps:

S101: According to the traffic load form, traffic infrastructure structure characteristics and soil parameters required for the test, improving a PID algorithm in a control system by using DRL method: inputting parameters such as driving speed, axle weight and soil properties through the control system to build an experience pool and a feedforward neural network, and then initializing the parameters.

The feedforward neural network comprises an online policy network, a target policy network, an online critic network and a target critic network. The online critic network follows the following formula (1), and then initializing the parameters to make the network parameters of the target critic network reach expected values.

$$Q_{(s_t,a_t)} = \mathbb{E}_{h\sim p^{\theta}(\cdot)}\left[\sum_{n=t}^{\infty}\gamma^{n-1}r(s_n, \mu_\theta(s_n))|s_t, a_t\right] \tag{1}$$

where, $s_t$ denotes input state, $a_t$ denotes feedback behavior, and $\mu_\theta$ denotes policy network. S102: building training samples to train the feedforward neural network, and obtaining preliminary loading spectrum and loading frequency.

Setting a control mode of the system to be controlled by an output of a Proportional-Integral (PI) controller, and recording data at preset time intervals $\Delta t$. The data comprises a state deviation $e_t$ between a given amount and a target amount at time t, a state deviation variation $\Delta e_t$ at the time t, and a control amount variation $\bar{u}$ at the time t. Then, taking the $e_t$ and $\Delta e_t$ as inputs, and the $\bar{u}$ as an output to train the online policy network, generating new network parameters and obtaining trained online policy network, so as to obtain preliminarily a loading time curve of each servo channel. After that, cutting off the output of the PI controller, and recording an output control quantity $u_{t-1}$ of a previous time: then, inputting $e_t$ and $\Delta e_t$ of a current time into the online policy network to obtain an output $$\Delta u_t^{(f)}$$

of the network. Using output control quantity $$\Delta u_{t-1}^{(f)}$$

of the previous time and the output $$\Delta u_t^{(f)}$$

of the network to calculate $$\Delta^2 u_t^{(f)}$$

according to equations (2) and (3), obtaining the controller $\widehat{U_t}$ by equation (4). After the switching is completed, the above steps are repeated to realize that the online policy network controls the system.

$$\Delta u_t^{(f)} = f\Delta u_{t-1}^{(f)} + (1-f)\frac{u_t - u_{t-1}}{\Delta t} \tag{2}$$

$$\Delta^2 u_t^{(f)} = \frac{\Delta u_t^{(f)} - \Delta u_{t-1}^{(f)}}{\Delta t} \tag{3}$$

where, $f \in [0,1]$, is a fixed parameter.

$$\bar{u}_t = [k_p k_i k_d k_\tau]\begin{bmatrix} \Delta e_t \\ \Delta te_t \\ -\Delta^2 u_t^{(f)} \\ \Delta te_{t-1} \end{bmatrix} + U_{t-1} \tag{4}$$

Collecting process variables of the system in real-time, the variables comprise the state deviation $e_t$ between the given amount and the target amount at the time t, the state deviation variation $\Delta e_t$ at the time t, the control variable variation $\bar{u}$ at time t, the state deviation $e_{t+1}$ between the given amount and the target amount at a time t+1, the state deviation variation $\Delta e_{t+1}$ at the time t+1, a reward value θ at the time t, and the like: storing the process variables in an experience pool. After that, repeating S102 continuously to train the network parameters until it is judged that an iteration condition is satisfied.

Wherein, training the network parameters is: randomly selecting N data from the experience pool as training samples, and each the sample comprises parameters at the time t and t+1, which are $e_t$, $\Delta e_t$, $\bar{u}$, $e_{t+1}$, and $\Delta e_{t+1}$. The equation (4) comprises second-order output information, and system operation usually has time delay, so the historical data of reinforcement learning is defined as $$h_t = \left[\Delta e_t, \Delta te_t, -\Delta^2 u_t^{(f)}, \Delta te_{t-1}^{(U)}, U_{t-1}\right]: s_t = [h_{t-d}, \ldots, h_t] \tag{5}$$

S103: continuously training the network and updating network parameters based on loss function and stochastic gradient descent algorithm until it is judged that the iteration condition is satisfied, and finally outputting stable loading spectrum of actuator.

inputting the $e_t$ and the $\Delta e_t$ at the current time into the online policy network to obtain the output of the network $$\Delta u_t^{(f)};$$

inputting the $e_{t+1}$ and the $\Delta e_{t+1}$ at the time t+1 into the target policy network to obtain an output of the target policy network $$\Delta u_{t+1}^{(f)};$$

inputting the $e_t$ and the $\Delta e_t$ at the current time and the output of the online policy network $$\Delta u_t^{(f)}$$

into the online critic network to obtain an output of the online critic network $Q_{(i)}$; inputting the $e_{t+1}$ and the $\Delta e_{t+1}$ at the time t+1 and the output of the target policy network $$\Delta u_{t+1}^{(f)}$$

into the target critic network to obtain an output of the target critic network $$Q_m^{(i)};$$

updating network parameters of the online critic network by utilizing a neural network back propagation algorithm based on the loss function to obtain updated network parameters of the online critic network; updating network parameters of the online policy network based on the stochastic gradient descent algorithm to obtain updated network parameters of the online policy network; finally, updating network parameters of the target policy network and the target critic network according to the updated network parameters of the online critic network and the updated network parameters of the online policy network.

Wherein, the loss function is expressed as follows:

$$\mathcal{L}_p(\phi) = \frac{1}{N}\sum_{i=1}^{N}\left(Q_m^{(i)} - Q_\phi\left(s^{(i)}, a^{(i)}\right)\right)^2 \tag{6}$$

According to $$Q_m^{(i)} = r\left(s^{(i)}, a^{(i)}\right) + \gamma Q_\phi\left(s'^{(i)}, \mu_\theta\left(s'^{(i)}\right)\right),$$

and s' represents a next state of a trajectory tracking $\mu_\theta$ of the policy network, so that equation (6) can be transformed into:

$$\mathcal{L}_x(\theta) = \frac{1}{N}\sum_{i=1}^{N} Q_\theta\left(s^{(i)}, \mu_\theta\left(s^{(i)}\right)\right) \tag{7}$$

Usually, $\nabla\mathcal{L}_x$ will be used as an approximation of $\nabla J(\theta)$, according to $\theta' = \theta + \alpha\nabla J(\theta)$, an update equation for the PID can be obtained by continuous training on $k_p$, $k_i$, $k_d$, and $k_\tau$:

$$\theta' \approx \theta + \alpha\nabla\left(\frac{1}{N}\sum_{i=1}^{N} Q_\phi\left(s^{(i)}, \mu_\theta\left(s^{(i)}\right)\right)\right) \tag{8}$$

$$= [k_p k_i k_d k_\tau]^T + \alpha\frac{1}{N}\sum_{i=1}^{N}\left(\left[\Delta e_t, \Delta te_t, -\Delta^2 u_t^{(f)}, \Delta te^{(U)}\right]^T\right)^{(i)}\nabla_a Q_\phi\left(s^{(i)}, a\right)\Big|_{a=\mu_\theta\left(s^{(i)}\right)} \tag{9}$$

After that, returning to S102 until it is judged that the iteration condition is satisfied, and finally outputs the time-history loading curve of each servo channel in a stable state.

S104: controlling the hydraulic system 12 to work by the multi-servo channel control system 11, so as to realize the multi-cylinder dynamic and static cooperative cyclic loading, and the dynamic response of the subgrade or foundation under long-term load can be simulated in a short time. At the same time, different static loads are applied to the restraining plate to simulate the ballast and restraint of the overlying structure on the subgrade or foundation.

S105: monitoring in real-time, by the monitoring element 9, multiple information, such as deformation, stress, pore pressure, temperature and moisture of subgrade soil, and transmitting the monitored information to the multi-servo channel control system 11 in real-time.

S106: performing, by the multi-servo channel control system 11, comprehensive analysis and judgment according to the multi-information such as dynamic stress characteristics received by the subgrade or foundation, and completing intelligent regulation of the working state of the actuator under each servo channel.

Example 3

Figure 4:
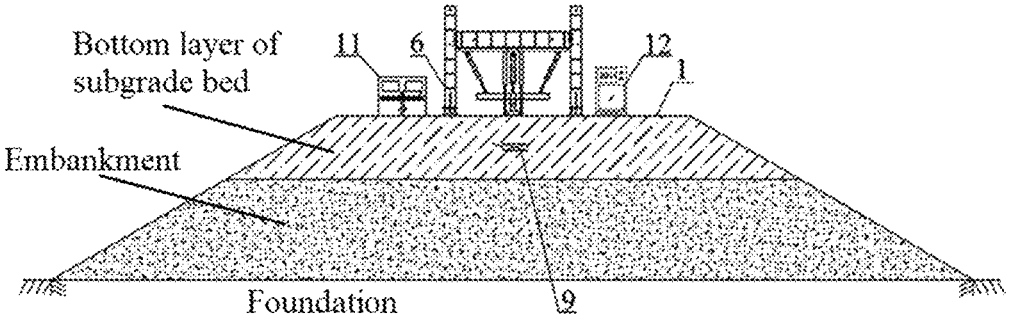
FIG. 4 is a schematic diagram of an application of the system for loading dynamic stress on subgrade or foundation in one example of the present invention to railway subgrade.

The present example provides a dynamic stress loading test of an existing railway subgrade, and a field layout of a simulation loading system is shown in FIG. 4. The test steps are as follows:

(1) Arranging the loading device on site to connect to the surface of subgrade 1, and embedding a monitoring element 9 in the soil.

(2) Starting a multi-servo channel control system 11, opening a hydraulic system 12, adopting an oil source low pressure static control: firstly, setting protection values of test parameter, then controlling loading target values of the loading device.

(3) Turning to an oil source high-pressure dynamic force control, simulating the dynamic stress of subgrade under different traffic load conditions by inputting parameters such as driving speed, axle weight and soil properties, and setting cyclic loading times to simulate a long-term traffic load: according to the real-time monitored loading curve fed back by the system by the monitoring element 9 and the multi-information of the soil body of the subgrade fed back by the monitoring element 9, such as deformation, stress, pore pressure, temperature, moisture and like multi-information, performing, by the multi-servo channel control system 11, comprehensive analysis and judgment according to the multi-information such as dynamic stress characteristics received by the subgrade, and completing intelligent regulation of the working state of the actuator under each servo channel.

(4) When the set cycle loading times are reached, stopping the loading of the actuator, and transferring the oil source high pressure dynamic force control to the oil source low pressure static displacement control, making the loading device rise to separate from the loading interface.

(5) Closing the multi-servo channel control system1 and finally closing the hydraulic system 12.

Although the present invention has been disclosed in the preferred embodiments as described above, it is not intended to limit the present invention. Any person skilled in the art can use the methods and technical content disclosed above to make possible changes and modifications to the technical solution of the present invention without departing from the spirit and scope of the present invention. Therefore, any simple modifications, equivalent changes, and modifications made to the above embodiments based on the technical essence of the present invention that do not depart from the technical solution of the present invention are within the scope of protection of the technical solution of the present invention.

The invention claimed is:

1. A system for loading dynamic stress on subgrade or foundation based on multi-servo channel, comprising:

a connecting plate;

a connecting frame, wherein five dynamic actuators are hinged between the connecting frame and the connecting plate; wherein, four of the five dynamic actuators form a 4-revolute-pose-revolute (RPR) parallel mechanism, and another one is arranged in a middle of the 4-RPR parallel mechanism;

a loading part, being mounted at a center under the connecting frame; and a restraining plate, being provided under the loading part and configured to have free contact with the loading part; four static actuators are arranged between the restraining plate and the connecting plate; wherein, the four static actuators and the five dynamic actuators are dynamic-static cooperative controlled through multi-servo channel, to simulate an effect of principal stress axes rotation of a soil body of a subgrade or a foundation.

2. The system for loading dynamic stress on subgrade or foundation based on multi-servo channel according to claim 1, wherein the connecting frame is of a cross shape, and each of the four static actuator passes through interspaces between adjacent cross support rods of the connecting frame, respectively.

3. The system for loading dynamic stress on subgrade or foundation based on multi-servo channel according to claim 2, wherein hinge points of the 4-RPR parallel mechanism are arranged on the cross support rods of the connecting frame.

4. The system for loading dynamic stress on subgrade or foundation based on multi-servo channel according to claim 1, wherein one end of the each of the four static actuators is fixedly connected to the connecting plate, and another end of the each of the four static actuators is ball hinged with the restraining plate.

5. The system for loading dynamic stress on subgrade or foundation based on multi-servo channel according to claim 4, wherein the four static actuators are perpendicular to the connection plate and the restraining plate.

6. The system for loading dynamic stress on subgrade or foundation based on multi-servo channel according to claim 1, wherein a displacement sensor and an axial force sensor are installed inside the each of the four static actuators and each of the five dynamic actuators, respectively.

7. The system for loading dynamic stress on subgrade or foundation based on multi-servo channel according to claim 1, the system further comprises a multi-servo channel control system, wherein the multi-servo channel control system is configured to adjust independently a loading force of the each of the four static actuators and the each of the five dynamic actuators.

8. The system for loading dynamic stress on subgrade or foundation based on multi-servo channel according to claim 7, the system further comprises a monitoring element, wherein the monitoring element is embedded inside a subgrade structure or a foundation structure.

9. The system for loading dynamic stress on subgrade or foundation based on multi-servo channel according to claim 1, wherein the dynamic actuator arranged in the middle of the 4-RPR parallel mechanism is vertically arranged between the connecting plate and the connecting frame.

10. A control method of a system for loading dynamic stress on subgrade or foundation based on multi-servo channel according to claim 1, comprising the following steps:

building an experience pool and a feedforward neural network, initializing parameters of the network;

building training samples to train the feedforward neural network, and obtaining an initial loading spectrum and a loading frequency of an actuator;

training and updating continuously the parameters of the network based on a loss function and stochastic gradient descent algorithm, until an iterative condition is judged to be satisfied, and finally outputting a time-history loading curve of each servo channel in a stable state; and controlling, by a multi-servo channel control system, a dynamic and static cooperative cyclic loading of static and dynamic actuators, to simulate dynamic response of the subgrade or foundation under long-term load; simultaneously, applying different static loads to the restraining plate, to simulate varying degrees of ballast and restraint of an overlying structure on the subgrade or foundation.

* * * * *